United States Patent [19]

Kamohara

[11] Patent Number: 4,540,374

[45] Date of Patent: Sep. 10, 1985

[54] METHOD FOR MAKING CRT SHADOW MASKS

[75] Inventor: Eiji Kamohara, Fukaya, Japan

[73] Assignee: Tokyo Shibaura Denki Kabushiki Kaisha, Kanagawa, Japan

[21] Appl. No.: 696,881

[22] Filed: Jan. 31, 1985

Related U.S. Application Data

[63] Continuation of Ser. No. 444,334, Nov. 24, 1982, abandoned.

[30] Foreign Application Priority Data

Dec. 3, 1981 [JP] Japan ..... 56-193647

[51] Int. Cl.[3] ..... H01J 9/14; H01J 31/20

[52] U.S. Cl. ..... 445/37; 29/424

[58] Field of Search ..... 445/37, 47; 313/402; 29/423, 424

[56] References Cited

U.S. PATENT DOCUMENTS

| | | | |
|---|---|---|---|
| 2,971,117 | 2/1961 | Law . | |
| 3,046,202 | 7/1962 | Horner et al. | 445/37 |
| 3,663,997 | 5/1972 | Kuznetzoff | 445/37 |
| 4,107,569 | 8/1978 | Ronde | 313/402 |
| 4,112,563 | 9/1978 | van Esdonk | 445/37 |
| 4,207,656 | 6/1980 | van Esdonk et al. | 445/37 |
| 4,392,914 | 7/1983 | Takenaka et al. | 313/402 |

FOREIGN PATENT DOCUMENTS

| | | | |
|---|---|---|---|
| 141849 | 9/1982 | Japan | 313/402 |
| 53166 | 3/1967 | Luxembourg . | |

*Primary Examiner*—Kenneth J. Ramsey

*Attorney, Agent, or Firm*—Cushman, Darby and Cushman

[57] ABSTRACT

A method of making a mask structure including two or more masks for a color cathode ray tube, for example a mask-focusing color cathode ray tube, and the mask structure formed by the method. A plurality of apertured flat masks, each mask having an effective portion having apertures and non-effective portion surrounding the effective portion, are aligned and stacked with a predetermined gap. The gap is then filled with filling material, which solidifies thereby fixing the flat masks together. The fixed masks are simultaneously pressed into a predetermined curved shape. The filling material is then removed from the curved masks.

8 Claims, 11 Drawing Figures

METHOD FOR MAKING CRT SHADOW MASKS

This is a continuation of application Ser. No. 444,334, filed Nov. 24, 1982, which was abandoned upon the filing hereof.

BACKGROUND OF THE INVENTION

The present invention relates to a method of making a mask structure including two (2) or more masks for a color cathode ray tube (CRT). Particularly, the masks are positioned at a small distance from the CRT's phosphor screen and are separated from each other.

One such CRT having this type of mask structure is the mask-focusing color picture tube. In a mask-focusing color picture tube, different potentials are applied to the masks and an electrostatic lens is formed between the facing masks. The electron beam utility factor is significantly increased compared with a conventional shadow mask type color CRT. A mask-focusing color picture tube is described in Japanese Utility Model publication No. 38930/1972, and U.S. Pat. Nos. 2,971,117 and 3,398,309.

Another type of CRT which has the above described mask structure is described in Japanese Patent Publication No. 2698/1980. This color CRT has two masks. One mask acts as a color selection electrode and the other mask acts as an electron shield for preventing the other mask from being bombarded by electron beams and from being deformed by its rising temperature resulting from that bombardment.

In both types of color CRTs, the corresponding apertures of the masks must be aligned coaxially with the electron beams. However, it is difficult to make such a mask structure. Japanese Patent Publication No. 28188/1972 discloses a method of making such a mask structure. According to this method, on one surface of one shadow mask a glass insulating layer is formed. Then the glass insulating layer is etched from the shadow mask side to form apertures. After that, another shadow mask is attached on the glass insulating layer. The mask structure made by this method has the glass insulating layer between two shadow masks in an effective area. Therefore, it is difficult to press-form the mask structure into a curved shape. Further, the glass insulating layer is charged up by electron beam bombardment and electron beams passing through the apertures are affected by such charge. Thus this mask structure is not practical.

Recently a practical method for making such a mask structure for a CRT was proposed in Japanese Patent Application No. 141740/1981. According to this method, a plurality of apertured flat masks are stacked and fixed together with paraffin. Then they are simultaneously pressed into predetermined shape. However, after pressing the masks, they have to be separated from each other at a predetermined gap. At this time, thin shadow masks tend to be deformed and the corresponding apertures may be offset. Thus the beam utility factor can easily be reduced.

SUMMARY OF THE INVENTION

An object of the present invention is to provide a method of making a plurality of masks for a color CRT, which method facilitates the precise alignment desired for the corresponding aperture of each mask.

Therefore the present invention provides a method of making a mask structure including at least two (2) masks for a CRT including the steps of: preparing a plurality of flat masks, each mask having an effective portion having a plurality of apertures and a non-effective portion surrounding the effective portion; stacking the flat masks with a predetermined gap; filling the apertures of the flat masks and the gap with filling material; solidifying the filling material thereby fixing the flat masks together; simultaneously pressing the fixed flat masks in a predetermined curvature; and removing the filling material from the curved masks.

The present invention also provides a mask structure formed by the above described manufacturing steps.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
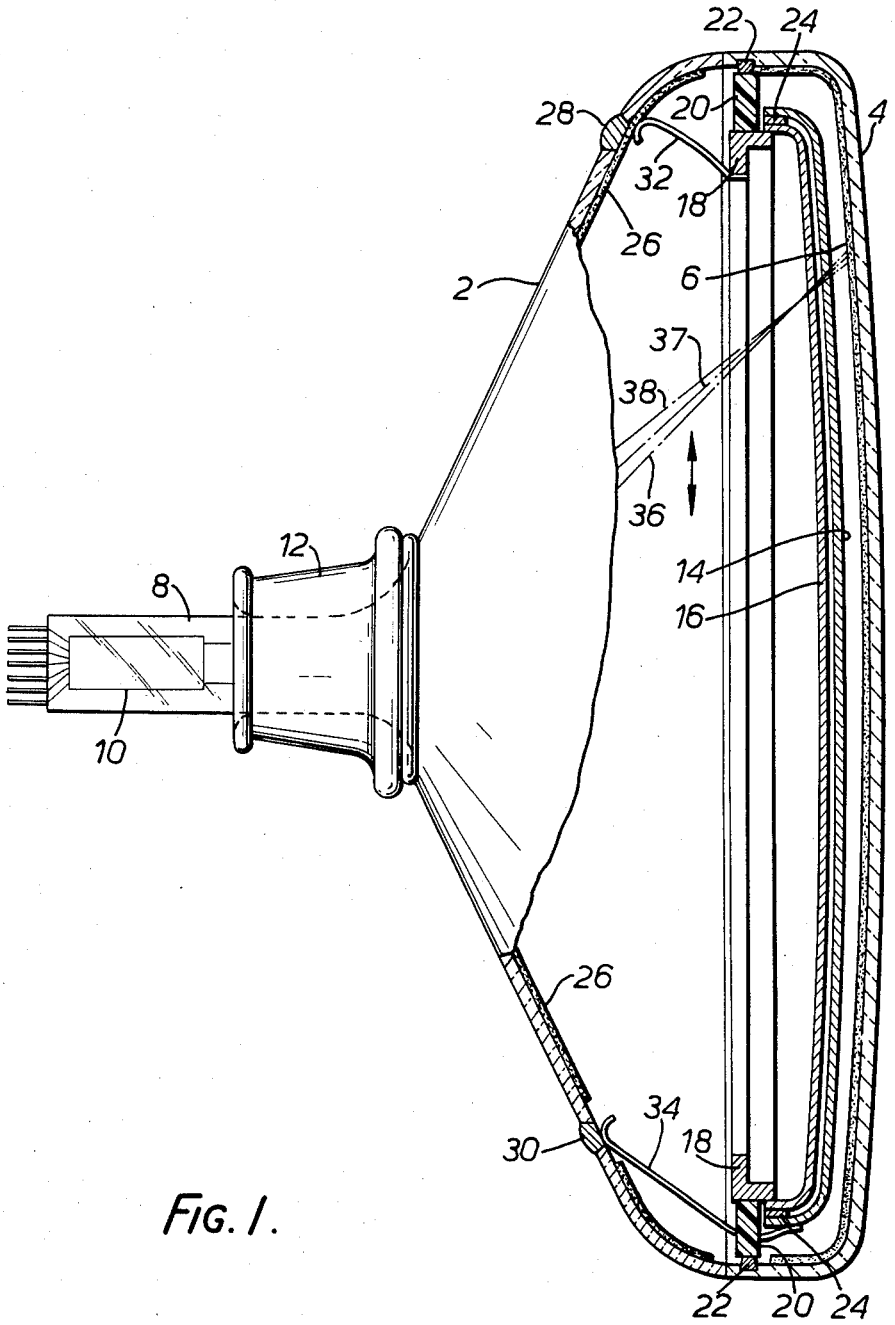
FIG. 1 is a cross-sectional view of a mask focusing color cathode ray tube employing the mask structure of the present invention.

FIG. 1 shows a cross-sectional view of a mask-focusing color picture tube including a mask structure having two (2) masks formed according to the present invention. A funnel 2 is joined to the outer periphery of a face plate 4, on the inner surface of which is formed a metal-backed phosphor screen 6. A neck 8 is joined to the end of funnel 2. Electron guns 10 are disposed within neck 8. A conventional deflection apparatus 12 is mounted on the outer surfaces of funnel 2 and around neck 8. A first shadow mask 14 is mounted in opposition to phosphor screen 6, and a second shadow mask 16 is mounted in opposition to first shadow mask 14. First and second masks 14 and 16 each have a plurality of apertures therethrough. Second shadow mask 16 is mounted to face place 4 by a mask frame 18, resilient support members 20 and pins 22. First shadow mask 14 is mounted to second shadow mask 16 through an insulating member 24.

The metal-backed phosphor screen 6 has phosphor stripes of regularly alternating three colors coated on the inner surface of face plate 4, and a thin metal layer formed on the phosphor stripes. A conductive film 26 is uniformly coated on the inner surface of funnel 2 and on part of the inner surface of neck 8. Two electrical contact buttons 28 and 30 are mounted on funnel 2 for applying the different voltages from the outside. Button 28 is electrically connected to conductive film 26 and to a resilient conductive connector 32 connecting to mask frame 18 and the metal-backed phospher screen layer 6 through pins 22. Button 30 is electrically connected to first shadow mask 14 through a resilient conductive connector 34. The applied potential of metal-backed phosphor screen 6 and second mask 16 is slightly higher than the potential applied to first shadow mask 14.

In the color picture tube as described above, three electron beams 36, 37 and 38 emitted from the electron guns 10 and deflected by deflection apparatus 12 are selectively focused by second and first shadow masks 16 and 14, and the beams pass through their respective apertures and impinge on the appropriate phosphor stripes of screen 6, which then emit light of the corresponding color. Therefore the corresponding apertures of each mask must be arranged coaxially. The method steps according to the present invention for fabricating the masks and forming the resulting product will be described below.

Figure 2:
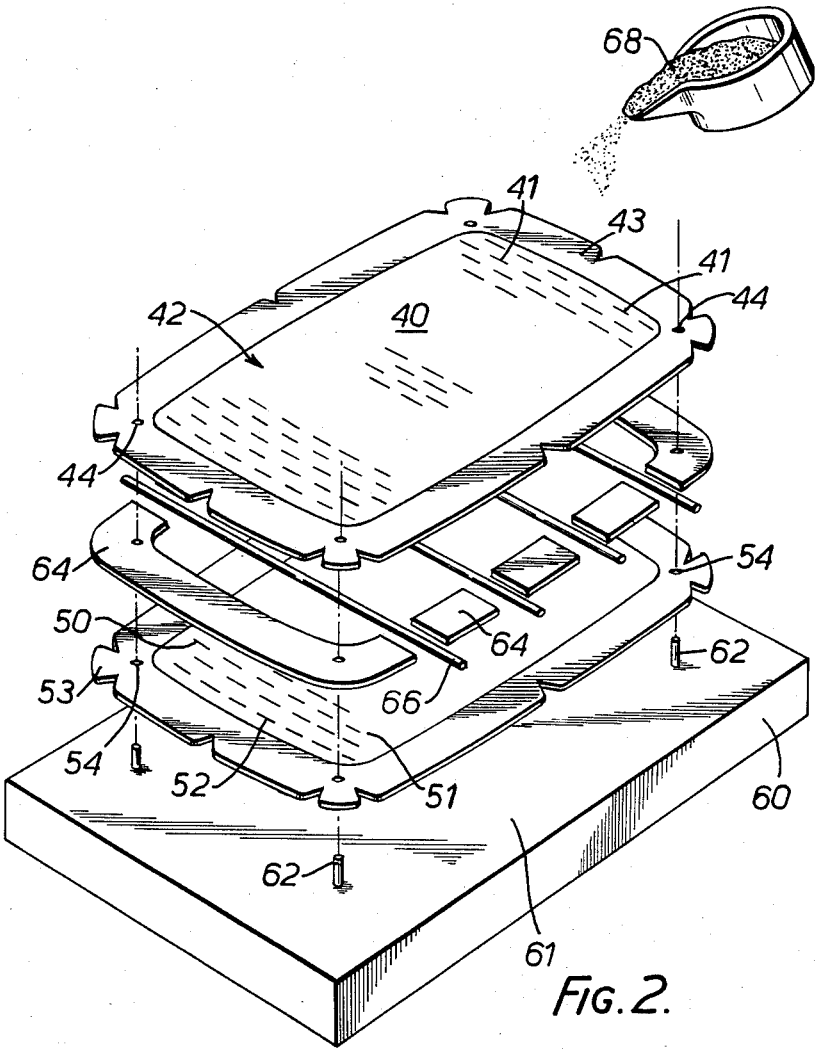
FIG. 2 is a perspective view illustrating the fabrication method of the present invention.

Referring now to FIG. 2, one embodiment of the present invention is illustrated. Each apertured flat mask 40 and 50 includes an effective portion 41 and 51 respectively having a plurality apertures 42 and 52 respectively and a non-effective portion 43 and 53 surrounding the effective portion. Guide holes 44 and 54 for positioning the corresponding apertures of each mask are provided at the four corners of the non-effective portion. A surface plate 60 has a flat surface 61 and location regulating pins 62. When guide holes 44 and 54 of each mask are adapted to location regulating pins 62, the corresponding apertures of each mask are aligned with high precision.

Figure 3:
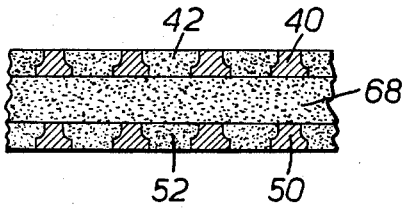
FIG. 3 is an enlarged cross section of the fixed flat masks showing one step of the invention.

Flat mask 50 is placed on flat surface 61 of surface plate 60 with reference to location regulating pins 62. Then first spacers 64 of insulating material are set on the non-effective portion of the flat mask and second spacers 66 extend across the effective portion. Second spacers 66 are wire-like and extend beyond the non-effective portion. Both first and second spacers 64 and 66 have same thickness, which corresponds to the desired gap between the two masks of the final product. Polymide film is preferable as the first spacer, because of ease of forming, resistance to high temperature and insulating characteristics. As the second spacer an insulated nickel chromium wire is preferable. After setting spacers 64 and 66, another flat mask 40 is stacked on the spacers with reference to location regulating pins 62. Then heat melted paraffin 68 is poured on flat mask 40. The paraffin penetrates into the apertures of flat masks 40 and 50 and the gap between the flat masks, and gap and apertures are filled with paraffin. The penetrated paraffin is then cooled, and becomes solidified and so masks 40 and 50 and spacers 64 and 66 are firmly fixed together by the solidified paraffin. Next, an electrical voltage is applied to second spacers to generate resistive heat to melt the paraffin surrounding the second spacers, which can then be pulled out. After that, the paraffin is cooled again to resolidify. FIG. 3 shows an enlarged cross section of the flat masks fixed by the solidified paraffin. Two flat masks 40 and 50 are fixed firmly by solidified paraffin 68 because of the complex configuration of apertures 42 and 52 in masks 40 and 50.

Figure 4:
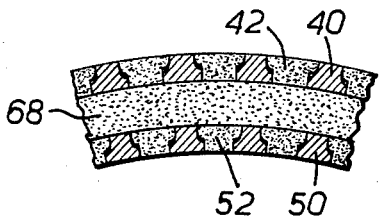
FIG. 4 is an enlarged cross section of the curved masks showing one step of the invention.

The fixed flat masks are then simultaneously pressed to a predetermined shape, in a manner known in the prior art for pressing a shadow mask of conventional cathode ray tube. During the pressing step, the solidified paraffin filled in the apertures will conform to the curvature of the mask so that sliding and non-uniform stretching of the masks are prevented. FIG. 4 shows an enlarged cross section of the masks after pressing. The apertures of each flat mask are so designed as to correspond after pressing. Even though the masks are fixed by the solidified paraffin to minimize the sliding between the masks, it is preferable to bond the first spacer to the masks with adhesive.

After pressing the masks, the paraffin is removed from the pressed masks and then the inner mask is welded to the mask frame. Then the mask is held to the mask frame only by press forming. When the masks are thick, the other mask is held firmly. Adhesive coupling by heat resistive adhesive material to increase reliability is preferred. The paraffin can be removed by washing with trychroloethylene, ether or hot alcohol.

A specification of one embodiment is as follows. Each flat mask has an outline of about 428 mm×330 mm, an effective portion of about 328 mm×290 mm and thickness of 0.30 mm. The gap between both masks is set at 0.5 mm. Therefore, the thicknesses of the first and second spacers are 0.5 mm respectively. The radius of curvature on the effective portion is about 740 mm to 800 mm.

In the mask structure manufactured by the above described manner, the corresponding apertures of each mask exactly correspond to each other. No insulating spacer is left on the effective portion so that the charging drawback discussed in the background of the invention can be eliminated.

Figure 5:
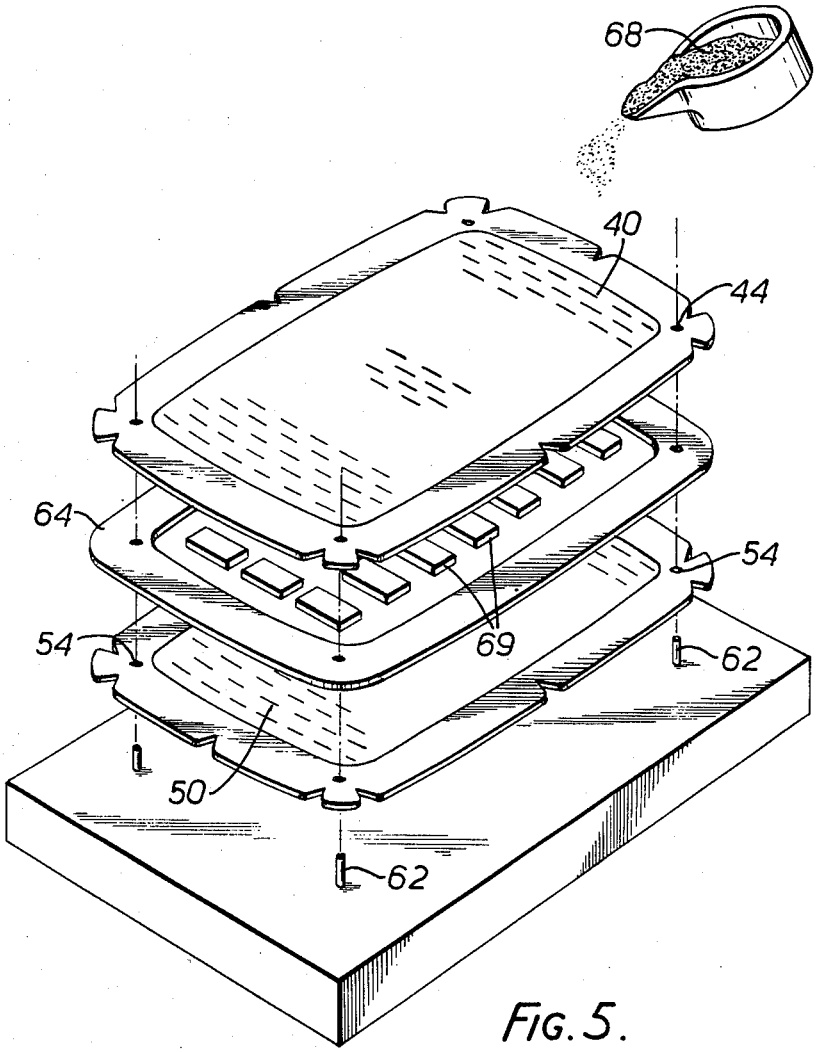
FIG. 5 is a perspective view illustrating the fabricating method of another embodiment.

In the above described embodiment, a wire-like spacer is used as the second spacer for ease of removal. However, the second spacer is not limited to the wire-like spacer. FIG. 5 shows another embodiment of the invention. Plate like spacers 69 are disposed on the effective portion of the flat mask 50 instead of the wire-like spacers of the above described embodiment. Plate like spacers 69 are distributed on the entirety of the effective portion 51. The plate like spacer is made of, for example, cellulose acetate.

Figure 6:
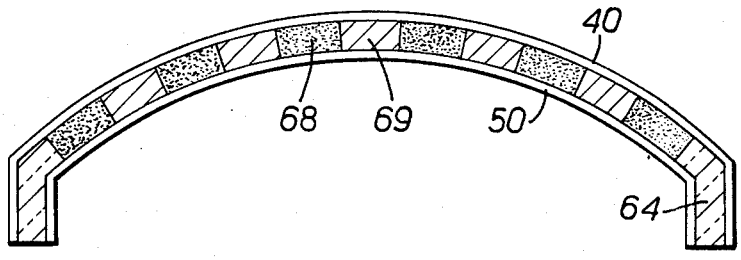
FIG. 6 is a cross section of the curved masks showing one step of the invention.
Figure 7:
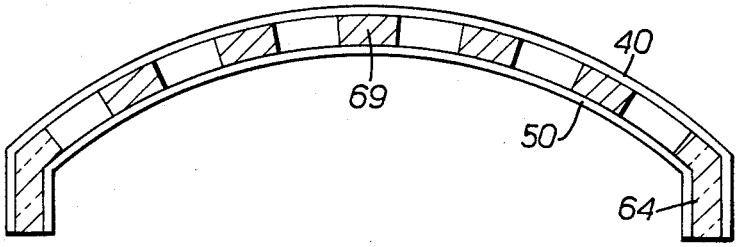
FIG. 7 is a cross section of the curved masks showing another step of the invention.
Figure 8:
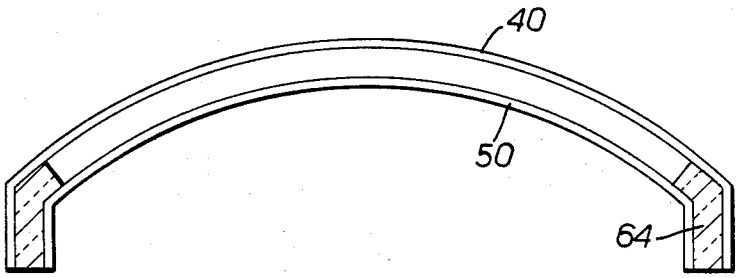
FIG. 8 is a cross section of the curved masks showing yet another step of the invention.

After setting a first spacer 64 and plate like second spacer 69, another flat mask 40 is placed on spacers 64 and 69 with reference to location regulating pins 62. Then heat melted paraffin is poured onto flat mask 40. The paraffin penetrates in the apertures and fills in the gap between the flat masks. The paraffin then is cooled and becomes solidified. The flat masks fixed by the paraffin are then simultaneously pressed in a predetermined curvature shape as shown in FIG. 6. The masks are then washed with hot alcohol and the paraffin is removed as shown in FIG. 7. Then the plate like second spacer of cellulose acetate is dissolved by acetone and the second spacer is thereby removed as shown in FIG. 8.

In this embodiment, many spacers can be arranged on the effective portion so that the gap between the two masks can be correctly set over the effective portion. Aluminum and vinyl can also be used as the second spacer even though cellulose acetate is referred. These materials can be dissolved by a suitable solution without any damage to the masks or the first spacer.

Figure 9:
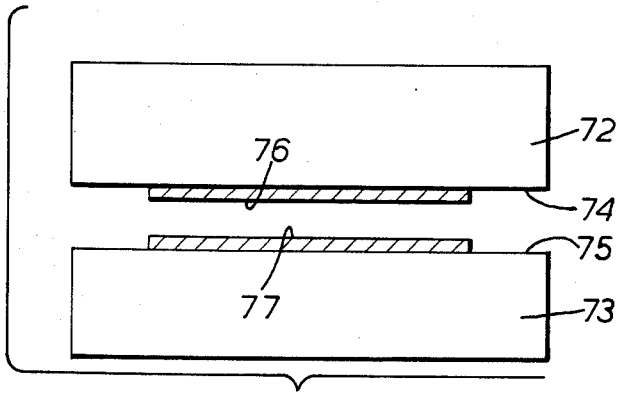
FIG. 9 is a cross section illustrating one step of the fabrication method of yet another embodiment.

Even though the above described embodiments use the second spacers on the effective portion to keep a spacing between two masks, the second spacers can be eliminated. FIG. 9 shows such an embodiment. Two electromagnets 72 and 73 having flat surfaces 74 and 75 are opposed to each other. Each apertured flat mask 76 and 77 is attracted to each electromagnet 72 and 73 respectively. Their relative positions are regulated with reference to location regulating means (not shown), for example the guide holes of the flat masks and the location regulating pins provided on the electromagnets. The first spacer 64 is placed on the non-effective portion of the flat mask 75. Electromagnet 72 is moved to electromagnet 73 against the repulsion of magnetic force. Under such circumstances, melted paraffin penetrates into the gap between the flat masks and the apertures from the side of the stacked masks. Then paraffin is cooled to solidify. After solidifying the paraffin, electromagnets 72 and 73 are deactivated so as to remove the fixed flat masks. The masks fixed by paraffin are pressed into a predetermined shape as shown in above described embodiments. Then the paraffin is removed.

Figure 10:
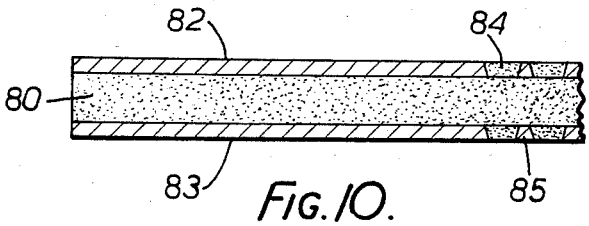
FIG. 10 is a cross section showing one step of further embodiment.
Figure 11:
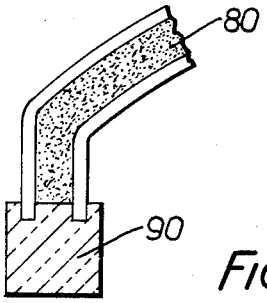
FIG. 11 is a cross section showing another step of the invention.

All embodiments described above have the first spacers between the non-effective portions of the masks. However, the first spacer also can be eliminated. As shown in FIG. 10, paraffin 80 can be filled in the gap between non-effective portions 82 and 83 as well as the gap between effective portions 84 and 85. In this embodiment, the electromagnetic apparatus as shown in FIG. 9 is utilized. After pressing the masks, fixing members 90 are attached at several portions of the peripheral of the pressed masks as shown in FIG. 11. After that, paraffin is removed from the masks.

In the above-described embodiments, paraffin is used as filling material, however, other materials can be used as paraffin substitutes as long as they meet the following criteria. First, the material must be a liquid or have a desired viscosity so it is pourable and must be capable of being solidified in some manner after being poured. Second, it must be dissolvable or decomposable in some manner. For example, phenol resin, polyvinyl resin, gelatin and varnish are preferably used as the filling material. In the described embodiments paraffin is employed because of its cheap price and its ease of handling.

According to the present invention, two apertured flat masks are stacked with a predetermined gap and the apertures and the gap are filled with filling material and two masks are firmly fixed together by solidified filling material. Then the two masks are simultaneously pressed into the desired shape. Thus, it is easy to align the corresponding apertures of each mask, and sliding and non-uniform stretching of the masks are prevented. Further it is unnecessary to move the curved mask for setting a predetermined gap after removing the filling material. Therefore, it decreases the probability of deforming the curved masks during handling.

In the above described embodiments, the first spacer is made of insulating material. However, conductive material, for example aluminum, can be used as the first spacer, particularly in case of the one mask acting as an electron shield.

While the invention has been described in connection with what is presently considered to be the most practical and preferred embodiments, it is to be understood that the invention is not to be limited to the disclosed embodiments but on the contrary, is intended to cover various modifications and equivalent arrangements included with the spirit and scope of the appended claims which scope is to be accorded the broadest interpretation so as to encompass all such modifications and equivalent structures.

What is claimed is:

1. A method of making a mask structure for a cathode ray tube comprising the steps of:

preparing a first flat mask including an effective portion having a plurality of apertures therein and a non-effective portion surrounding said effective portion;

disposing a first spacer structure on said non-effective portion of said first mask and a second spacer structure on said effective portion of said first flat mask;

arranging a second flat mask on said first and second spacer structures, thereby forming a predetermined gap between said first and second flat masks, said second flat mask including an effective portion having a plurality of apertures therein and a non-effective portion surrounding said effective portion;

filling said apertures of said first and second flat masks and said gap with a filling material having a viscosity so as to be pourable;

solidifying said filling material, thereby fixing said flat masks together;

simultaneously pressing said fixed flat masks into a predetermined curvature; and removing said second spacer structure from said curved masks.

2. A method according to claim 1, wherein said filling material comprises at least one material selected from the group consisting of phenol resin, epoxy resin, polyvinyl resin, paraffin, geratine and varnish.

3. A method according to claim 2, wherein said filling material is paraffin.

4. A method according to claim 1, wherein said second spacer structure comprises plate-like spacers.

5. A method according to claim 1, said step of removing said second spacer structure comprises the step of dissolving said second spacer structure.

6. A method of making a mask structure for a cathode ray tube comprising the steps of:

attracting a first flat mask to a first electromagnet, said first flat mask including an effective portion having a plurality of apertures and a non-effective portion surrounding said effective portion;

attracting a second flat mask to a second electromagnet, said second flat mask including an effective portion having a plurality of apertures and an non-effective portion surrounding said effective portion;

arranging said first and second flat masks attracted to said first and second electromagnet in parallel spaced apart relation with corresponding apertures aligned;

filling said apertures of said first and second flat masks and a space formed between said flat masks with filling material having a viscosity so as to be pourable;

solidifying said filling material, thereby fixing said flat masks together;

deactivating said first and second electromagnets;

removing said first and second electromagnets from said fixed flat masks;

simultaneously pressing said fixed flat masks into a predetermined curvature; and removing said filling material from said curved masks.

7. A method according to claim 6, wherein said arranging step includes the step of disposing a spacer between said non-effective portions of said first and second flat masks.

8. A method of making a mask structure according to claim 6, wherein said method further includes the step of fixing said curved masks at peripheral portions of said non-effective portion between said pressing step and said removing step of removing said filling material.

* * * * *